US006991240B2

(12) United States Patent
Grella et al.

(10) Patent No.: US 6,991,240 B2
(45) Date of Patent: Jan. 31, 2006

(54) TOE RAMP SYSTEM

(75) Inventors: Jeffrey Grella, Newport Beach, CA (US); Martin Dalgaard, Topanga, CA (US)

(73) Assignee: Vans, Inc., Santa Fe Springs, CA (US)

( * ) Notice: Subject to any disclaimer, the term of this patent is extended or adjusted under 35 U.S.C. 154(b) by 91 days.

(21) Appl. No.: 10/740,217

(22) Filed: Dec. 17, 2003

(65) Prior Publication Data

US 2004/0145156 A1 Jul. 29, 2004

Related U.S. Application Data

(60) Provisional application No. 60/422,197, filed on Jan. 24, 2003.

(51) Int. Cl.

| | |
|---|---|
| ***B62B 9/04*** | (2006.01) |
| ***A63C 5/00*** | (2006.01) |
| ***A63C 9/00*** | (2006.01) |
| ***A63C 1/24*** | (2006.01) |

(52) U.S. Cl. ..... 280/14.21; 280/14.24; 280/607; 280/636; 280/11.14

(58) Field of Classification Search ..... 280/14.21, 280/14.22, 14.24, 11.3, 11.31, 11.14, 607, 280/609, 613, 614, 615, 616, 617, 618, 620, 280/624, 625, 633, 634, 636; 248/188.2
See application file for complete search history.

(56) References Cited

U.S. PATENT DOCUMENTS

| | | | | |
|---|---|---|---|---|
| 4,135,736 A | | 1/1979 | Druss | 280/636 |
| 4,586,727 A | * | 5/1986 | Andrieu et al. | 280/607 |
| 5,503,900 A | | 4/1996 | Fletcher | 428/160 |
| 5,697,631 A | | 12/1997 | Ratzek et al. | 280/613 |
| 5,775,717 A | | 7/1998 | Bobrowicz | 280/607 |
| 5,971,407 A | | 10/1999 | Zemke et al. | 280/14.2 |
| 6,113,114 A | | 9/2000 | Zemke et al. | 280/14.26 |
| 6,145,868 A | * | 11/2000 | Schaller et al. | 280/624 |
| 6,189,911 B1 | | 2/2001 | Caron et al. | 280/607 |
| 6,315,305 B1 | * | 11/2001 | Gien | 280/14.24 |
| 6,328,328 B1 | * | 12/2001 | Finiel | 280/636 |
| 6,386,574 B1 | * | 5/2002 | Tanaka | 280/624 |
| 6,467,795 B1 | * | 10/2002 | Hirayama et al. | 280/613 |
| 6,485,035 B1 | * | 11/2002 | Laughlin et al. | 280/14.21 |
| 6,520,531 B1 | * | 2/2003 | Gien | 280/618 |
| 6,575,490 B1 | * | 6/2003 | Laughlin | 280/618 |
| 6,808,196 B2 | * | 10/2004 | Des Ouches | 280/636 |
| 2004/0094917 A1 | * | 5/2004 | Frigo et al. | 280/11.31 |

* cited by examiner

*Primary Examiner*—Christopher P. Ellis
*Assistant Examiner*—Gerald B Klebe
(74) *Attorney, Agent, or Firm*—Winston & Strawn LLP

(57) ABSTRACT

A toe ramp system for use with a snowboard binding. The system includes a toe ramp for adjustable attachment to a front portion of a base plate of the snowboard binding and including a toe ramp interlocking structure associated with a toe ramp rear wall. Also included is a first spacer having a first interlocking structure associated with a first wall for removable attachment to the toe ramp interlocking structure and having a second interlocking structure associated with a second wall for removable attachment to a base plate wall. In an implementation, the system also includes at least a second spacer having a third interlocking structure associated with a front wall for removable attachment to the second interlocking structure of the first spacer, and having a fourth interlocking structure associated with a rear wall for removable attachment to the base plate wall.

24 Claims, 4 Drawing Sheets

TOE RAMP SYSTEM

This application claims the benefit of copending U.S. Provisional patent application No. 60/442,197 filed on Jan. 24, 2003, which is incorporated by reference herein.

BACKGROUND

The invention generally relates to a toe ramp system for a snowboard binding. The system includes one or more spacers that provide improved control and improved vibration and/or dampening characteristics.

Snowboard bindings are typically categorized as being either strap-type bindings for use with soft-style snowboard boots, or step-in type bindings for use with snowboard boots having bales or some other form of mating device. Both types of snowboard bindings function to securely fasten the snowboard boots of a rider to a snowboard.

As the sport of snowboard riding has evolved, various new snowboard binding features have been introduced by snowboard equipment manufacturers to improve performance and to consequently improve their products. One such development is the addition of an adjustable toe ramp for snowboard bindings. The toe ramp enhances the transfer of the load and/or pressure from the foot of a rider to the snowboard to provide improved control of the snowboard.

A conventional toe ramp is mounted to the front end of the base portion of a snowboard binding, and typically includes a flat or upwardly extending front portion for engagement with the toe portion of a snowboard boot of a rider. The toe ramp improves toe-side edge responsiveness of the snowboard in comparison to bindings that do not include such a toe ramp. In particular, toe side edge forces from the riders' foot are quickly transmitted to the snowboard through the toe ramp as the snowboarder travels down a slope. Conventional toe ramps allow a rider to adjust the position of the ramp in the front to rear position and/or the side-to-side position to accommodate a variety of snowboard shoe sizes.

However, as a rider adjusts the toe ramp to a front position on the binding, a gap or void appears between a rear surface of the toe ramp and the base portion of the binding. The size of the gap is typically proportional to the size of the riders' snowboard boot. This gap can become clogged with ice and/or snow which could adversely affect the binding mechanism of step-in type bindings. Furthermore, the void does nothing to dampen vibrations or to absorb shocks that are generated by the snowboard and that travel through the binding, into the snowboard boot and to the foot of the rider.

SUMMARY OF THE INVENTION

Presented is a toe ramp system for use with a snowboard binding. The system includes a toe ramp for adjustable attachment to a front portion of a base plate of the snowboard binding and including a toe ramp interlocking structure associated with a toe ramp rear wall. Also included is a first spacer having a first interlocking structure associated with a first wall for removable attachment to the toe ramp interlocking structure and having a second interlocking structure associated with a second wall for removable attachment to a base plate wall.

In an advantageous implementation, the system also includes at least a second spacer having a third interlocking structure associated with a front wall for removable attachment to the second interlocking structure of the first spacer, and having a fourth interlocking structure associated with a rear wall for removable attachment to the base plate wall.

Any or all of the spacers may be made of a shock absorbing material, or a dampening material, or a composite material with shock absorbing and dampening characteristics. In a beneficial embodiment, the spacer first wall is shaped to flush fit with the toe ramp rear wall, and the spacer second wall is shaped to flush fit with the base plate wall. The first interlocking structure may be a flange and the second interlocking structure may be a receptacle, and the first and second walls of the spacer could be curved. The toe ramp may also include at least one well for accommodating at least one fastener, and the well may house at least one of a plurality of through holes or a slot. The toe ramp system may also include at least one fastener for adjustably connecting the toe ramp to the base plate, the toe ramp may be adjustable in a plurality of front-to-rear positions, and may include a contoured surface.

Another embodiment according to the invention pertains to a snowboard binding of the type that includes a base plate having a toe portion, the binding for releasably securing a snowboard boot to the base plate. The binding includes a toe ramp having an upper surface for supporting engagement with a toe portion of a snowboard boot, at least one fastener for adjustably securing the toe ramp to the toe portion of the base plate, and at least one spacer. The spacer has at least one first structure for releasably interlocking with the toe ramp and at least one second structure for releasably interlocking with the base plate. The spacer is selected and positioned by a rider between the toe ramp and a wall of the base plate to accommodate the size of a snowboard boot sole and provides enhanced snowboard riding characteristics.

In an advantageous implementation, the snowboard binding includes at least a second spacer having a third interlocking structure for removable attachment to the second interlocking structure of the first spacer, and a fourth interlocking structure for removable attachment to the base plate. The spacer may be made of a shock absorbing material, or of a dampening material, or of a composite material to provide a combination of shock absorbing and dampening characteristics. In addition, the spacer may be shaped to flush fit with both the toe ramp and the base plate. The first interlocking structure could be a flange and the second interlocking structure may be a receptacle. The toe ramp may also include at least one well for accommodating at least one fastener, and the well may house at least one of a plurality of through holes or a slot. At least one fastener could be included for adjustably connecting the toe ramp to the base plate, the toe ramp may be adjustable in a plurality of front-to-rear positions, and the toe ramp could also include a contoured surface.

The invention also pertains to a method for providing enhanced control and improved snowboard riding characteristics for a snowboard binding. The technique includes providing a toe ramp that is adjustably attached to a front portion of a base plate of the snowboard binding having a toe ramp interlocking structure, and providing at least one spacer having a first interlocking structure for removable attachment to the toe ramp interlocking structure and having a second interlocking structure for removable attachment to the base plate. The spacer includes at least one of a shock absorbing material and a dampening material.

The toe ramp system according to a preferred embodiment of the invention includes at least one spacer for providing beneficial dampening and/or vibration absorbing characteristics for a snowboard binding. Moreover, the spacer fills the void that would otherwise exist between the toe ramp and a base plate of the binding to prevent ice and/or snow or other foreign matter from clogging that space. The presence of such materials may detrimentally affect the performance of the binding.

BRIEF DESCRIPTION OF THE DRAWINGS

Other aspects, purposes and advantages of the invention will become clear after reading the following description with reference to the attached drawings, in which.

Like reference numbers in the various drawings denote like elements.

DETAILED DESCRIPTION OF THE PREFERRED EMBODIMENTS

Figure 1:
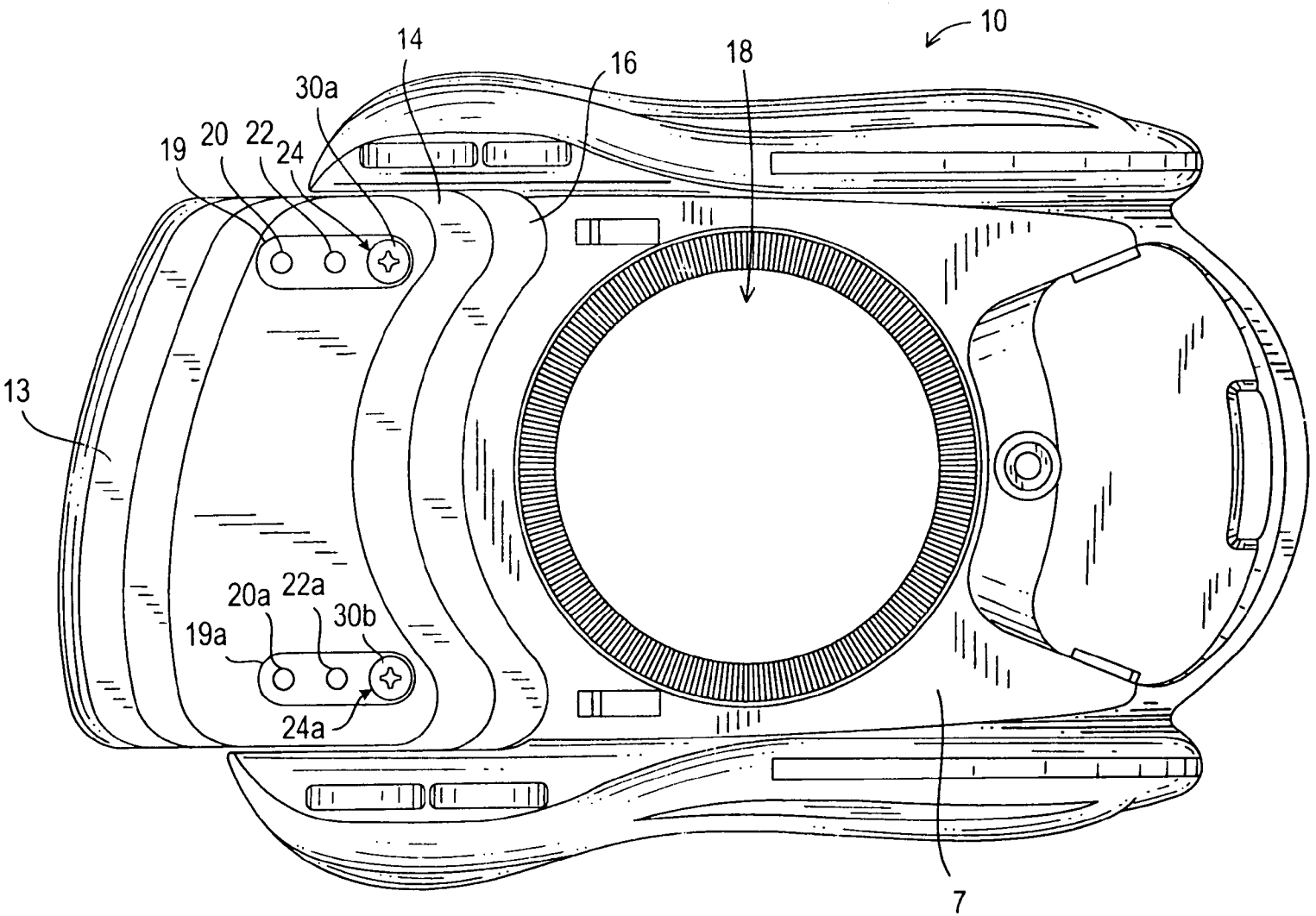
FIG. 1 is a top view of a snowboard binding that incorporates a toe ramp and spacer configuration according to the invention.

FIG. 1 is a top view of a snowboard binding 10 that incorporates an embodiment of a toe ramp 12 and a first spacer 14 and a second spacer 16 configuration. The binding 10 includes a hold-down disk (not shown) that fits into receptacle 18 to adjustably attach the binding 10 to a snowboard (not shown). A snowboard rider utilizes the binding 10 to connect her boot to the snowboard in a known manner.

Figure 2:
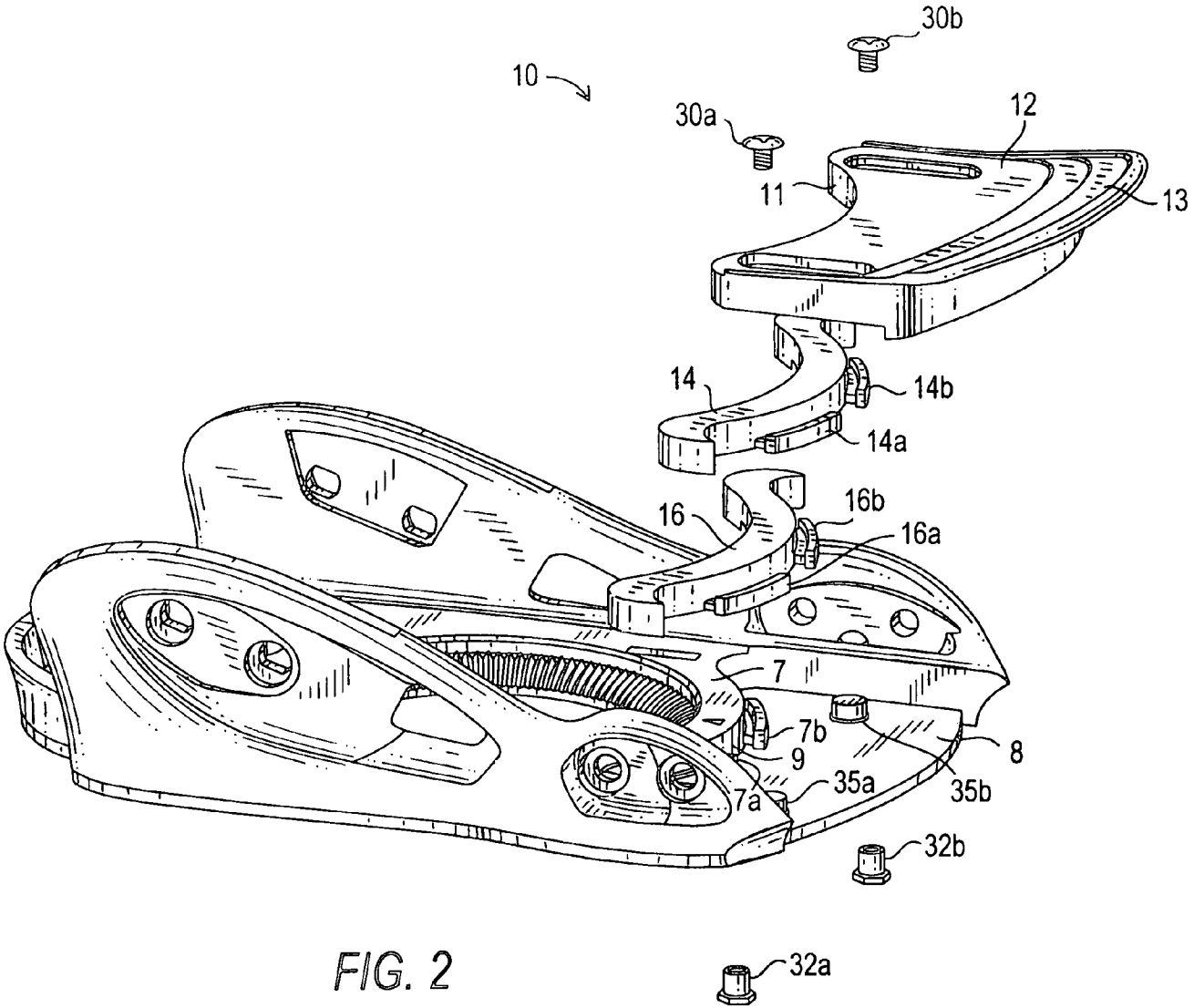
FIG. 2 is an exploded perspective view of the binding of FIG. 1 including a toe ramp and spacer configuration according to the invention.

FIG. 2 is an exploded perspective view of the binding 10 of FIG. 1 illustrating the interconnections between the toe ramp 12, the first spacer 14 and the second spacer 16. The toe ramp 12 has a contoured upper surface 13 that rises slightly to conform to the shape of the bottom surface of a snowboard boot. The implementation shown and described includes a toe ramp and two spacers of similar or equal size and/or similar dimensions, but it should be understood that other embodiments are contemplated that utilize more or less spacers which may have different sizes or dimensions. The number of spacers and their dimensions may vary depending on the overall configuration of an embodiment, and the number of spacers utilized may also depend upon user preferences.

Referring again to FIG. 1, the toe ramp includes a pair of wells 19 and 19*a* that house pairs of through holes, 20 and 20*a*, 22 and 22*a*, and 24 and 24*a*. (FIG. 1 shows screws 30*a* and 30*b* seated in the holes 24 and 24*a*.) The wells include ledge portions that provide a seat for screws 30*a* and 30*b* so that the screw heads are below the surface of the toe ramp 12, and thus the screw heads do not contact the soles of the riders' snowboard boots. The through hole pairs allow front to rear stepped adjustment of the length of the binding including the toe ramp and one or more spacers, to accommodate riders wearing different sizes of snowboard boots. For example, since both spaces 14 and 16 are being used, the through-hole pair 24 and 24*a* are utilized to fasten the toe ramp 12 to ledge portion 8 in the front area of the binding. The wells 19 and 19*a* could instead house slots to accommodate the screws or other types of fasteners.

As shown in FIG. 2, the first and second spacers 14 and 16 include two flange portions 14*a*, 14*b* and 16*a*, 16*b*, respectively. The binding base 7 also includes flanges 7*a*, 7*b*. These flanges are shaped to interlock with receptacles of either another adjacent spacer or the toe ramp 12. For example, in the implementation shown in FIGS. 1 and 2, the spacers 14 and 16 are both used in conjunction with the toe ramp 12. The second spacer 16 is positioned so that two receptacles (not shown) on the rear wall of the spacer 16 align with the base flanges 7*a* and 7*b* to interlock when the second spacer is seated onto the ledge portion 8 of the binding base. Similarly, the first spacer 14 is positioned so that two receptacles (not shown) on the rear wall of the spacer 14 align with the flanges 16*a* and 16*b* to interlock when the spacer 14 is also seated onto the ledge portion 8 of the binding base. The toe ramp 12 is then positioned so that two receptacles (not shown) on the rear wall of the toe ramp align with the flanges 14*a* and 14*b* of the first spacer to interlock when the toe ramp is also seated onto the ledge portion 8 of the binding base. A rider then inserts screws 30*a* and 30*b* through the hole pair 24 and 24*a* to engage nuts 32*a*, 32*b* which may be housed in receptacles 35*a* and 35*b* that are associated with the ledge portion 8 of the binding base. The first and second spacers 14 and 16 therefore interlock to the base 7, to the toe ramp 12, and to each other and provide a flat supporting surface for the boot to binding interface in the area of the forefoot. The screws 30*a* and 30*b* are then tightened to secure the selected assembly of the toe ramp and spacers to the binding. The binding may be configured to permit a rider to adjust the length of the binding by adding or subtracting spacers of various sizes even if the binding is attached to a snowboard.

In the implementation shown in the figures, the first and second spacers 14 and 16 are utilized when the toe ramp 12 is adjusted to a forward position by a rider. If the toe ramp 12 were to be adjusted to the same forward position without the use of one or more spacers, then a void would be created between the wall 9 of the binding base 7 (which includes flanges 7*a* and 7*b*) and the rear wall 11 of the toe ramp 12.

The spacers are designed to interlock with each other when combined in addition to locking with the base and toe ramp. In the implementation shown, a tongue and groove type configuration is used to create a mechanical connection. However, it should be understood that this interlocking feature could be achieved through a number of alternative designs that would be apparent to one skilled in the art.

In the implementation shown in FIGS. 1 and 2, the curved-shape of the spacers is designed to allow the rear surface or wall of spacer 16 to be flush fit against the wall 9 of the binding base 7 while simultaneously being interlocked with the base and creating a mechanical connection. The front wall of spacer 16 is also flush fit against the rear wall of spacer 14, which in turn has its front surface flush fit against the rear surface 11 of the toe ramp 12. The spacers and toe ramp are thus interlocked and captured together in locations that are underneath or below the toe ramp surface, and provide a smooth top surface for the sole of a boot. The spacers are inserted and locked-in individually as the toe ramp is adjusted from the smallest size (closest to the wall 9 of the binding base 7) to each next largest setting and so on as spacers are added. In the implementation shown, a maximum of only two spacers may be used due to the number of through-hole pairs, but this can be increased or decreased depending on the overall size and structure of the binding. For example, a toe ramp 12 could be used that includes elongated wells 19 and 19*a* that house additional through-hole pairs, so that additional spacers can be used. Thus, each implementation of the present system is configured to eliminate any void between the base 7 and toe ramp 12 that would otherwise occur as the toe ramp is adjusted outward from the smallest to the larger sizes.

It should also be understood that the spacer design and materials not only fill the void that would otherwise be created, but also provide a support structure that may dampen vibration and/or absorb shocks as the rider glides down a slope. The present system provides the opportunity to create selected dampening and/or shock absorbing characteristics into the binding system. In particular, as a snowboard moves over the riding surface, various vibrations travels through the board. These vibrations are transferred from the board into the binding and eventually into the riders feet. As the vibration passes through the area of the forefoot where the spacers are located, the vibrations may be reduced (dampened) by varying degrees depending on the density of the spacers.

A combination and/or incorporation of different materials into the composition of the spacers may be used to dampen vibration or absorb shock to varying degrees. In particular, a spacer can be made of any foam, viscoelastic, solid or composite material in a single or plurality of densities and layers, positioned in such a way as to provide more or less supportive, dampening or absorbing qualities or characteristics. For example, a spacer can be made of a soft thermoplastic urethane (TPU) material, or a thermoplastic rubber (TPR) material, or a combination of such materials. Furthermore, several layers of a plastics material having varying densities could be used. The harder the material the more supportive the feature. The slower the recovery time of the material the more shock absorbing the feature. The faster the recovery of the material after a shock the more dampening the feature. Materials can also be combined to create a combination of features which may provide performance advantages to the rider. In addition, an array of different spacers could be offered to a snowboard rider so that she may decide on a combination or an amount of vibration dampening and/or shock absorbing characteristics as desired. The choice of dampening or shock absorbing spacers for use with the binding could be made by a rider depending on individual preference, and/or depending on the snow conditions, and/or depending on other factors.

Figure 3:
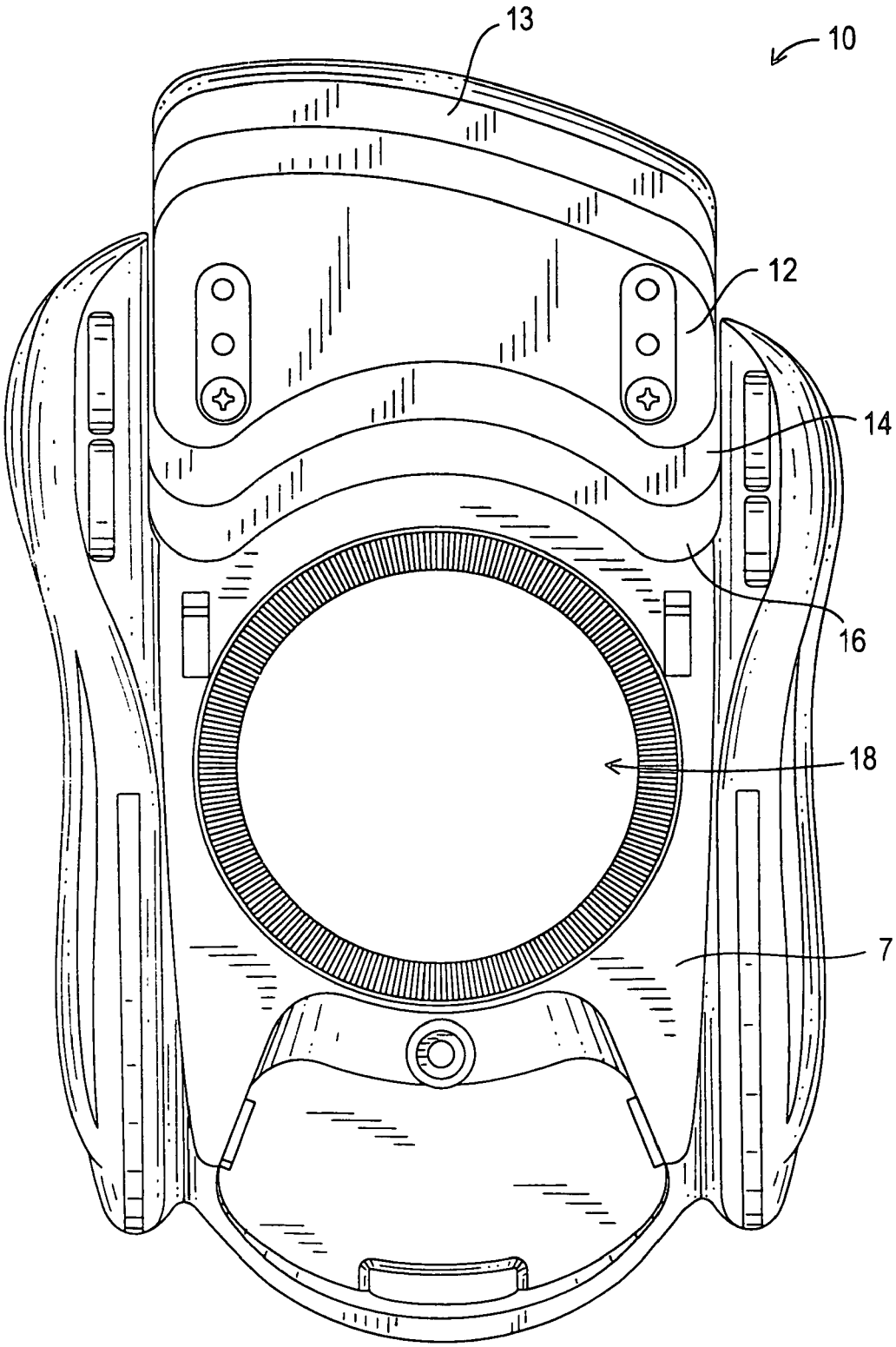
FIG. 3 is a three-dimensional contour drawing of FIG. 1.
Figure 4:
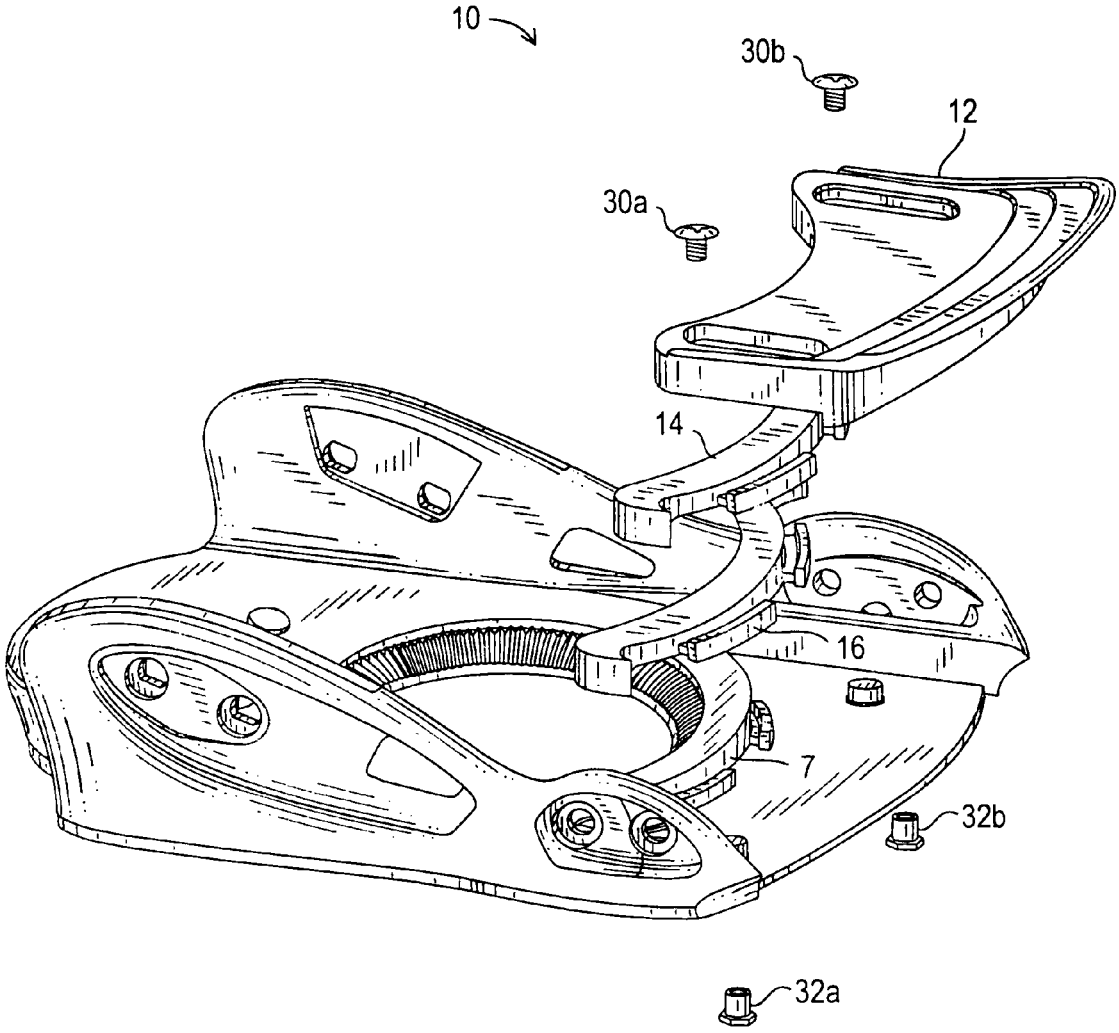
FIG. 4 is a three-dimensional contour drawing of FIG. 2.

FIG. 3 is a three-dimensional contour drawing of FIG. 1, and FIG. 4 is a three-dimensional contour drawing of FIG. 2. FIGS. 3 and 4 further illustrate the interconnections between the first and second spacers 14 and 16 and the toe ramp 12.

Although a particular implementation has been described, it should be understood that one of skill in the art could make many changes or modifications that would fall within the scope of the invention. For example, the size or shape of the spacers may be changed or modified, and different types of interlocking arrangements could be used, without departing from the spirit of the invention.

What is claimed is:

1. A toe ramp system for use with a snowboard binding comprising:

a toe ramp for adjustable attachment to a front portion of a base plate of the snowboard binding and including a toe ramp interlocking structure associated with a toe ramp rear wall;

a first spacer having a first interlocking structure associated with a first wall for removable attachment to the toe ramp interlocking structure and having a second interlocking structure associated with a second wall for removable attachment to a base plate wall; and at least a second spacer having a third interlocking structure associated with a front wall for removable attachment to the second interlocking structure of the first spacer, and having a fourth interlocking structure associated with a rear wall for removable attachment to the base plate wall.

2. The apparatus of claim 1 wherein the spacer is made of a shock absorbing material.

3. The apparatus of claim 1 wherein the spacer is made of a dampening material.

4. The apparatus of claim 1 wherein the spacer is made of a composite material with shock absorbing and dampening characteristics.

5. The apparatus of claim 1 wherein the spacer first wall is shaped to flush fit with the toe ramp rear wall, and the spacer second wall is shaped to flush fit with the base plate wall.

6. The apparatus of claim 1 wherein the first interlocking structure is a flange and the second interlocking structure is a receptacle.

7. The apparatus of claim 1 wherein the first and second walls of the spacer are curved.

8. The apparatus of claim 1 further comprising at least one fastener for adjustably connecting the toe ramp to the base plate.

9. The apparatus of claim 1 wherein the toe ramp is adjustable in a plurality of front-to-rear positions.

10. The apparatus of claim 1 wherein the toe ramp further comprises a contoured surface.

11. The apparatus of claim 1 wherein the toe ramp further comprises at least one well for accommodating at least one fastener.

12. The apparatus of claim 11 wherein the well houses at least one of a plurality of through holes or a slot.

13. A snowboard binding of the type that includes a base plate having a toe portion, the binding for releasably securing a snowboard boot to the base plate, comprising:

a toe ramp having an upper surface for supporting engagement with a toe portion of a snowboard boot;

at least one fastener for adjustably securing the toe ramp to the toe portion of the base plate;

at least one spacer having at least one first structure for releasably interlocking with the toe ramp and at least one second structure for releasably interlocking with the base plate, wherein the spacer is selected and positioned by a rider between the toe ramp and a wall of the base plate to accommodate the size of a snowboard boot sole and provides enhanced snowboard riding characteristics; and at least a second spacer having a third interlocking structure for removable attachment to the second interlocking structure of the first spacer, and having a fourth interlocking structure for removable attachment to the base plate.

14. The apparatus of claim 13 wherein the spacer is made of a shock absorbing material.

15. The apparatus of claim 13 wherein the spacer is made of a dampening material.

16. The apparatus of claim 13 wherein the spacer is made of a composite material to provide a combination of shock absorbing and dampening characteristics.

17. The apparatus of claim 13 wherein the spacer is shaped to flush fit with both the toe ramp and the base plate.

18. The apparatus of claim 13 wherein the first interlocking structure is a flange and the second interlocking structure is a receptacle.

19. The apparatus of claim 13 further comprising at least one fastener for adjustably connecting the toe ramp to the base plate.

20. The apparatus of claim 13 wherein the toe ramp is adjustable in a plurality of front-to-rear positions.

21. The apparatus of claim 13 wherein the toe ramp further comprises a contoured surface.

22. The apparatus of claim 13 wherein the toe ramp further comprises at least one well for accommodating at least one fastener.

23. The apparatus of claim 22 wherein the well houses at least one of a plurality of through holes or a slot.

24. A method for providing enhanced control and improved snowboard riding characteristics for a snowboard binding comprising:

providing a toe ramp that is adjustably attached to a front portion of a base plate of the snowboard binding and that includes a toe ramp interlocking structure;

providing at least one spacer having a first interlocking structure for removable attachment to the toe ramp interlocking structure and having a second interlocking structure for removable attachment to a base plate wall; and providing at least a second spacer having a third interlocking structure associated with a front wall of the second spacer for removable attachment to the second interlocking structure of the first spacer, and having a fourth interlocking structure associated with a rear wall of the second spacer for removable attachment to the base plate wall;

wherein the spacer comprises at least one of a shock absorbing material and a dampening material.

* * * * *

UNITED STATES PATENT AND TRADEMARK OFFICE

CERTIFICATE OF CORRECTION

PATENT NO. : 6,991,240 B2
DATED : January 31, 2006
INVENTOR(S) : Grella et al.

It is certified that error appears in the above-identified patent and that said Letters Patent is hereby corrected as shown below:

Title page,
Item [60], Related U.S. Application Data, change "60/422,197" to -- 60/442,197 --.

Signed and Sealed this

Twenty-eighth Day of March, 2006

JON W. DUDAS
*Director of the United States Patent and Trademark Office*